US006817590B2

(12) United States Patent
Gargiulo

(10) Patent No.: US 6,817,590 B2
(45) Date of Patent: Nov. 16, 2004

(54) METHOD AND TOOL FOR REMOVING MODULAR CONCRETE FORMS

(76) Inventor: Eugene Gargiulo, 41Commerce St., Durham, CT (US) 06422

( * ) Notice: Subject to any disclaimer, the term of this patent is extended or adjusted under 35 U.S.C. 154(b) by 355 days.

(21) Appl. No.: 10/012,624

(22) Filed: Dec. 7, 2001

(65) Prior Publication Data

US 2003/0106983 A1 Jun. 12, 2003

(51) Int. Cl.[7] ..... B28B 13/06

(52) U.S. Cl. ..... 249/205; 249/66.1; 7/166; 254/131.5

(58) Field of Search ..... 249/66.1, 205; 7/166; 29/426.5; 254/131.5

(56) References Cited

U.S. PATENT DOCUMENTS 394,547 A 12/1888 Thacker
1,270,970 A 7/1918 Rich
2,087,148 A 7/1937 Hempy
2,894,720 A 7/1959 Bennett
4,042,210 A 8/1977 Feldmann
4,703,549 A * 11/1987 Grandt ..... 29/426.5
4,745,651 A 5/1988 Schellanger
5,749,113 A 5/1998 Witter
5,855,358 A 1/1999 Witter

* cited by examiner

*Primary Examiner*—James P. Mackey
*Assistant Examiner*—Donald Heckenberg
(74) *Attorney, Agent, or Firm*—McCormick, Paulding & Huber LLP

(57) ABSTRACT

A method and tool for removing modular concrete forms from underlying rigid concrete are disclosed. The tool includes a lever end, a fulcrum, and a claw end having a notch particularly adapted to engage a knob that protrudes from a surface of the modular concrete form. The method includes engaging the claw end of the tool with the knob, abutting the fulcrum against rigid concrete adjacent the modular form, and exerting a force on the lever end in the direction of the adjacent rigid concrete.

7 Claims, 3 Drawing Sheets

METHOD AND TOOL FOR REMOVING MODULAR CONCRETE FORMS

FIELD OF THE INVENTION

This invention relates generally to methods and tools for building construction. It relates more particularly to a method and tool for removing modular concrete forms from underlying rigid concrete.

BACKGROUND

Certain building sections such as foundations for buildings or bridges are typically constructed with concrete for its advantages of high compressive strength, resistance to degradation by ground and water contact, and lower total cost as compared to stacked masonry units. These concrete building sections are usually framed by concrete forms that create a mold into which fluid concrete is poured and cures. Concrete forms may be of any rigid material that will withstand the pressures of poured concrete. Historically, concrete forms were typically made from plywood with a thickness of at least one-inch, custom cut for a particular job site. These plywood forms were then strengthened with various vertical and horizontal bracing as appropriate for the project at hand.

Recent changes in the industry have led to the use of pre-fabricated modular forms or panels in standard sizes, where the modular forms are intended to be reused over numerous and varied projects. Modular concrete forms of the type described herein are known in the art. These modular forms fit together easily and reduce the need for customized forms; thereby reducing the labor involved in arranging them to receive poured concrete. Modular concrete forms typically include knobs that protrude from the side opposite that confining the concrete. These knobs allow bracing to be readily secured to bind adjacent forms to each other and to strengthen them against separation or rupture from the weight of concrete poured behind them.

After the concrete is cured sufficiently, usually a few days, the forms are removed. Whether custom made or prefabricated modular forms, the surface of the forms against which concrete comes in contact are pre-treated with a release agent, typically a diesel fuel based fluid, to facilitate removal without destroying the forms. Workers generally force prybars, wedges or the like between the concrete form and the hardened concrete to break the bond between them. Some workers use a hooked end of the prybar to 'ratchet' the edge of a modular form away from the concrete structure. Using the prybar in this way tends to deform the edge or a surface of the modular form that hinders future use of the form. This is because the prybar's force is applied over a very limited surface area, whereas modular forms are engineered to withstand the forces of concrete applied broadly an entire surface. Other workers use a sledge to drive a wedge or the straighter end of a prybar between the modular form and the concrete to separate them. Both methods are used in the field and neither significantly reduces the strenuous labor of removing concrete forms from underlying rigid concrete. Neither method eliminates the need to forcibly insert a prybar tip between the modular form and the concrete to which it adheres, which is the most strenuous task in form stripping. Despite the release agent, many forms are bent, breached, or otherwise deformed during removal. This is a more significant concern with prefabricated modular concrete forms since their increased cost is often recouped only through repeated use.

What is needed in the art is a method and tool to minimize or overcome some of the above deficiencies. Based on the foregoing, it is an object of the present invention to provide such a method and tool for removing modular concrete forms from underlying concrete.

SUMMARY OF THE INVENTION

The present invention contemplates a method, a combination or apparatus, and a tool. The method of the present invention for removing modular concrete forms from rigid concrete comprises five distinct steps. First, provide a modular concrete form removal tool, wherein the tool itself comprising a claw end defining a notch particularly adapted to engage a knob protruding from the modular concrete form, a lever arm with an opposing end, and a fulcrum therebetween. Second, engage the claw end with the protruding knob. Third, place the fulcrum against an adjacent surface, such as the hardened concrete itself or an adjacent modular concrete form. Fourth, apply a force to the lever arm in the direction of the concrete so that the form will tend to separate from the hardened concrete. And repeating the process as necessary to remove additional modular forms.

The combination apparatus of the present invention comprises at least two modular concrete forms and a tool for removing a form from the concrete structure. More particularly, the modular concrete form comprises an interior surface to abut fluid concrete that is poured into the adjacent space. The form has an opposing second or exterior surface spaced from the interior surface, and knobs that project from the exterior surface. The tool of the apparatus comprises a claw end terminating in a tip and defining a notch particularly adapted to engage the knob, and a lever arm defining an end opposite the tip. The tool further includes a fulcrum between the claw end and the lever arm. This fulcrum forms an abutment surface that is disposed opposite a line between the tip and the end.

The tool of the present invention for removing modular concrete forms from hardened concrete comprises three main components: a claw end, a lever arm, and a fulcrum. The claw end terminates in a tip and has a notch particularly adapted to engage a knob protruding from the modular concrete form. The lever arm defines an end opposite the tip. The fulcrum is located between the claw end and the lever arm, and defines an abutment surface that is disposed opposite a line between the tip and the end. The abutment surface is spaced from the line by at least twice the thickness of the modular concrete form, and the fulcrum is attached to the remainder of the tool at a distance from the tip that is at least six times the thickness of the modular concrete form. The thickness of the modular concrete form is the distance between the form's interior and exterior surfaces.

DETAILED DESCRIPTION

Figure 1:
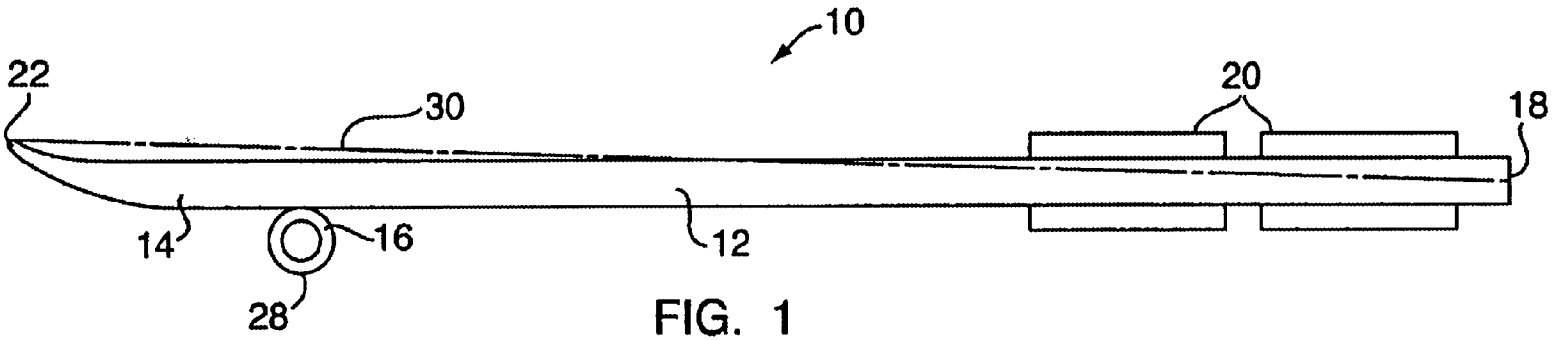
FIG. 1 is an elevational view of the tool of the present invention for removing modular concrete forms from underlying concrete.
Figure 2:
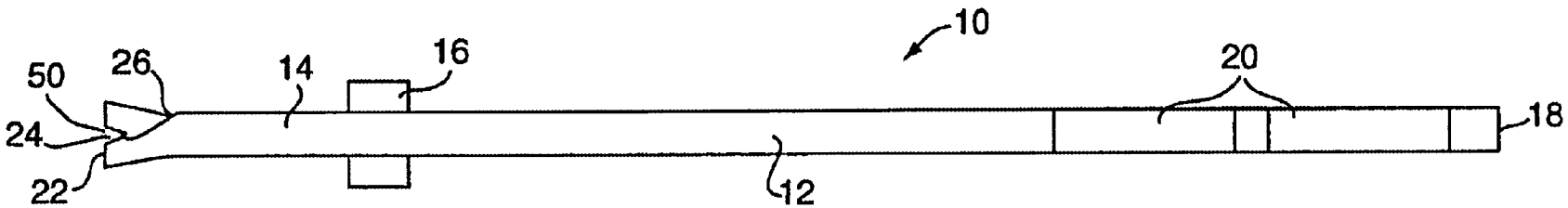
FIG. 2 is a plan view of the tool of FIG. 1.

A fuller appreciation for the present invention may be achieved by reference to the associated illustrations, wherein FIGS. 1 and 2 depict in differing views a tool 10 for removing modular concrete forms. The tool comprises a lever arm 12, a claw end 14, and a fulcrum 16 between them. The lever arm 12 is extended to provide a substantial moment arm about the fulcrum, preferably three to four feet in length. The lever arm defines an end 18 with a centroid (not shown), the centroid being the centerpoint of the surface that defines the end 18. The lever arm 12 may include handgrips or pads 20 for the user's comfort.

The claw end 14 defines a tip 22. As shown in the elevational view (FIG. 1), the claw end incorporates a cross section that narrows nearer the tip 22. This narrowing cross section is for easy engagement with a knob of a modular concrete form to be later described. The claw end further defines a notch 24, evident in the plan view of FIG. 2. The notch is particularly adapted to engage the knob previously mentioned. Preferably, the notch is defined by an arcuate surface 26, rather than by two converging linear surfaces as in prior art tools adapted for removal of nails and spikes. The notch of the present invention preferably does not score or deform the shank of the knob as prior art tools do to the shanks of nails or spikes.

The fulcrum 16 includes an abutment surface 28 for engaging a surface of hardened concrete, or any other sufficiently solid surface adjacent to the concrete form to be removed. The abutment surface is opposite a line 30 defined by the tip 22 and the centroid of the lever arm end 18, and is shown in phantom in FIG. 1. The tip 22 of the claw end 18 is preferably bent away from the fulcrum 16 as in many prybars. The fulcrum is preferably a hollow steel cylinder mounted so that its axis of rotation lies substantially perpendicular to the line 30 between the centroid and the tip, and is preferably welded to the remainder of the tool 10. It is preferably welded at a point within eighteen inches of the tip 18. Substantially perpendicular (or parallel) as used herein is limited to within 15° of the perpendicular (or parallel).

In a preferred embodiment of the tool of the present invention, the lever arm is three to four feet long and made of one-inch steel stock, the notch is slightly greater than one half inch wide, and the fulcrum is a two-inch diameter steel tube section welded eight inches from the tip. This is to accommodate many of the modular concrete forms in use having a thickness of one inch and knobs having a one-half inch diameter shank set approximately six inches inboard from an edge of the modular form.

Figure 3:
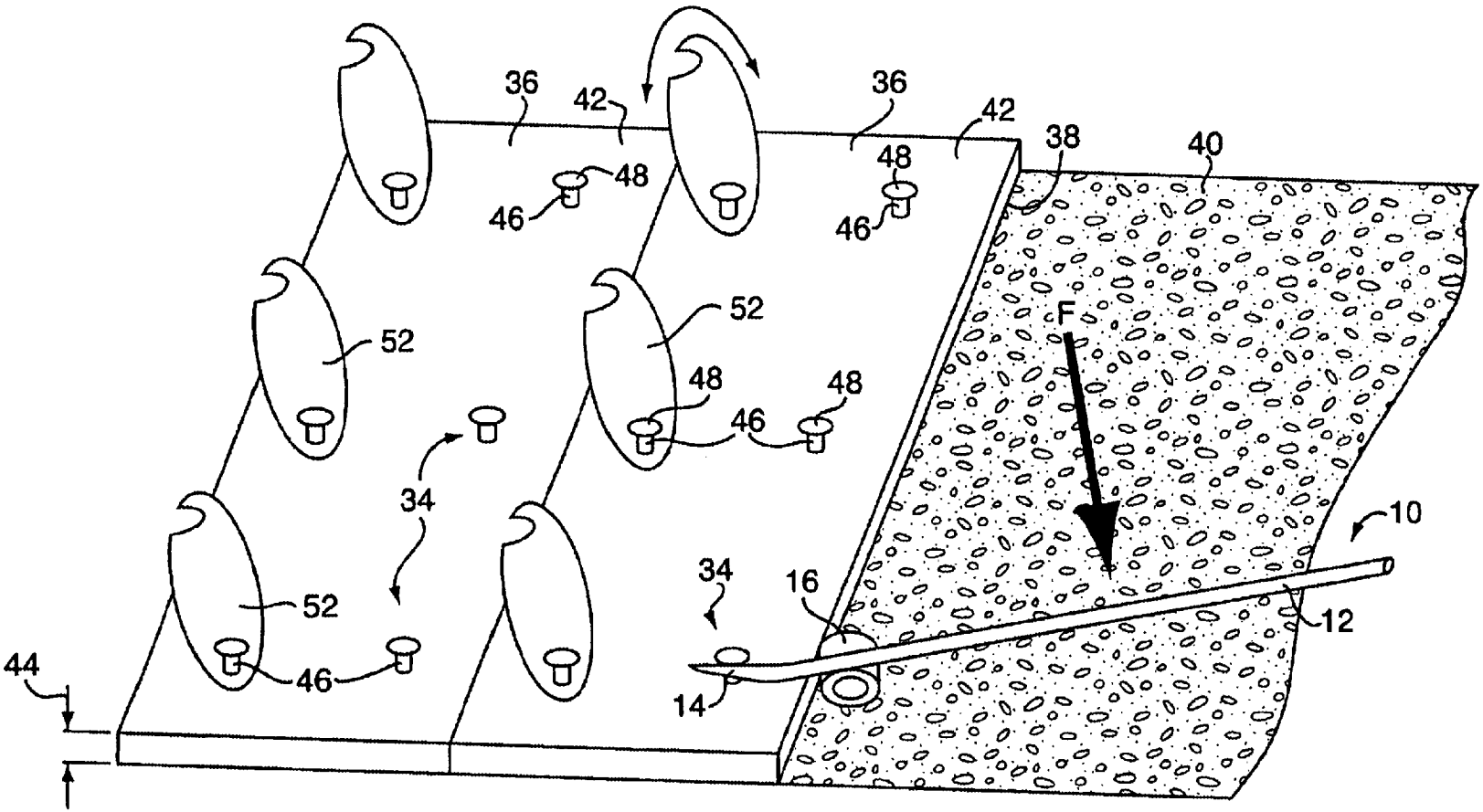
FIG. 3 is a perspective view of the tool of FIG. 1 engaged with a modular concrete form to remove it from an underlying concrete structure.

FIG. 3 depicts a perspective view of the tool 10 of FIG. 1 engaged with a protruding knob 34 of a modular concrete form 36. The modular form has an interior surface 38 that abuts a concrete surface 40 of the underlying concrete structure, and an exterior surface 42 opposite the first and spaced therefrom by a thickness 44. Through the exterior surface protrude shanks 46 terminating in caps 48 that together comprise the knobs 34. As best shown in FIG. 2, the arcuate surface 26 is rounded into an ellipsoid to prevent marring or scoring of the shank 46, as opposed to general purpose prybar claw ends that employ two converging surfaces each having acute angles that score and better grip a nail or spike. This arcuate surface 26 may or may not define an angle with the top of the tool (the top being shown in FIG. 2) or the opposing bottom, or it may blend via a rounded edge. The tip 22 also defines a notch opening 50 that is preferably slightly greater than one half of an inch wide, to easily accommodate a typical one half inch diameter shank. The entire surface of the tool's claw end that defines the notch may or may not be rounded. In a preferred embodiment, planar surfaces extend from the tip 22 and join with either side of the arcuate surface 26 to define the entire notch 24. Since the knob is engineered to withstand forces, transferred through bracing, that would tend to separate the cap 48 from the shank 46, the claw end 14 of the tool 10 imposes its primary force on the cap 48 when properly employed. This is opposed to prior art prybars that grip the shank of a nail or spike with lateral contact on either side of the shank, and may extract a nail even if the nail-head is sheared off.

Bracing in the form of steel bands or clips 52 interconnects the knobs of adjacent modular forms to reinforce the forms and to prevent their separation from one another. Each steel band or clip 52 mates with a shank 46 of at least two knobs on adjacent modular forms to hold them together. These bands 52 may be hingedly attached to the shanks 46 of one of the modular forms to be joined as shown in FIG. 3 (movement indicated by the double-headed arrow), or they may remain a separate component until attached. Additional vertical and/or horizontal bracing is often required to prevent deflection of the joined-together forms, especially for taller and wider concrete structures. Once the forms are set and all bracing is in place, concrete is poured behind the assembled modular forms. The bracing is removed once the concrete is sufficiently cured.

The modular forms generally remain attached by adhesion to the underlying cured concrete and may be stripped or removed in the following manner. The claw end 14 of the tool 10 is engaged with a knob 34 such that the notch 24 engages the shank 46 underneath the cap 48. The abutment surface 28 of the fulcrum 16 is placed against the rigid concrete surface 40 adjacent to the form 36 to be stripped. Rigid concrete as used herein refers to concrete that has cured at least 24 hours. A force is applied to the lever arm 12 in the direction indicated by the heavy arrow F, which is toward the concrete surface. This force drives the claw end 14 against the cap 48, thus pulling the entire modular form away from the underlying concrete structure and breaking the adhesive bond therebetween. The tool is subsequently separated from the knob 34 and the concrete surface 40. In this manner, the tool 10 is used to strip one or more modular concrete forms from underlying concrete without compromising the geometric or structural integrity of the form for future use.

Figure 4:
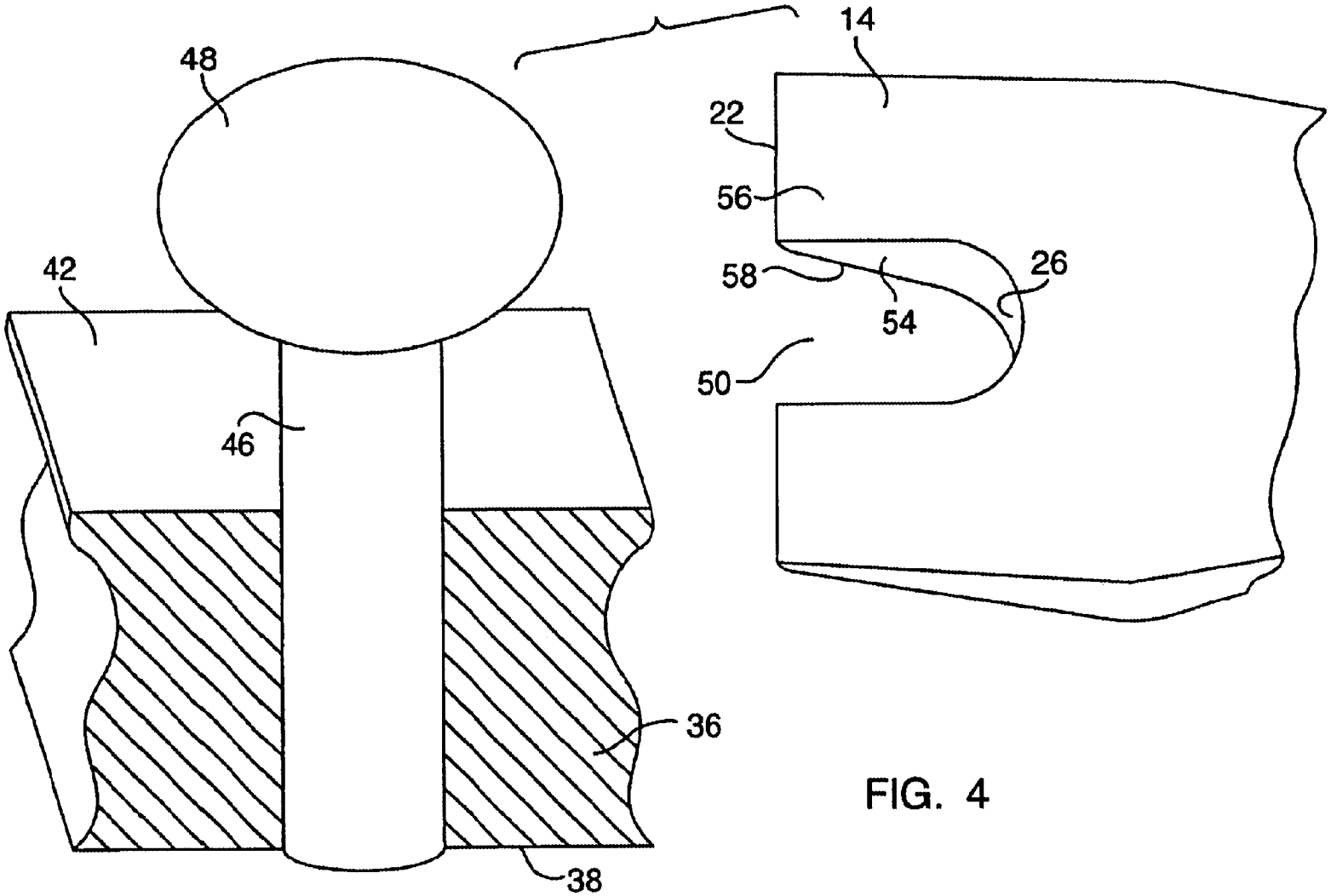
FIG. 4 is a perspective view close up of the claw end of the tool of FIG. 1 adjacent to a cutaway view of a modular concrete form.

FIG. 4 shows in perspective view a close up of the claw end 14 of the tool proximal to a shank 46 and cap 48 of a modular concrete form 36. The notch opening 50 is adapted to mate with the shank 46 of a knob protruding from a modular concrete form 36. The claw end 14 defines a cross section that narrows as it approaches the tip 22, as shown. The notch is defined in part by an arcuate surface 26, and in part by opposing sidewalls 54 (lead line points to only one sidewall). The arcuate surface 26 defines a curve that is complementary to a portion of the surface of the shank 46. The opposed sidewalls 54 lie in planes that are preferably substantially parallel to the knob's shank 46. At least one of and preferably both sidewalls 54 are substantially perpendicular to both an adjacent upper surface 56 and an opposing adjacent lower surface 58 of the claw end 14. When engaged with a knob protruding from a modular form 36, the sidewalls 54 lie in planes that are substantially perpendicular to the exterior surface 42 of the form. The sidewalls 54 may also be substantially parallel to one another.

Prior art prybars typically include incising edges (i.e.—surfaces that define sharply acute angles at their junctures) and diverging sidewall surfaces defining the notch to better grip the shanks of a variety of nails or spikes. The tool of the present invention is directed to a single purpose. It need not grip the shank of the knob but rather presses against the cap 48 with its claw end upper surface 56, and it need not be adaptable to a variety of shank sizes.

While the preferred embodiment and method have been shown and described, various changes and substitutions will be apparent to those skilled in the art and may be made without departing from the spirit and scope of the present invention. The embodiment and method described above is hereby stipulated as illustrative rather than exhaustive.

What is claimed is:

1. A tool for removing modular concrete forms from hardened concrete comprising:

a claw end terminating in a tip and defining a notch particularly adapted to engage a knob protruding from the modular concrete form, a lever arm defining an end opposite said tip, and a fulcrum between the claw end and the lever arm with an abutment surface disposed opposite a line between the tip and the end, wherein the abutment surface is spaced from the line by at least twice the thickness of the modular concrete form, and wherein the fulcrum is spaced from the tip by at least six times the thickness of the modular concrete form.

2. The tool as defined by claim 1 wherein the fulcrum is attached at least seven inches from the tip.

3. The tool as defined by claim 1 wherein the fulcrum is a cylinder.

4. The tool as defined by claim 3 wherein the cylinder defines an axis of rotation that is substantially perpendicular to the line.

5. The tool as defined by claim 1 wherein the fulcrum is spaced from the tip at least 14% of the total distance of the line.

6. The tool as defined by claim 1 wherein the claw end defines a notch having a rounded interior surface particularly adapted to engage the knob's cap without scoring the knob's shank.

7. The tool as defined by claim 6 wherein the tip defines a notch opening measuring at least one half inch across.

* * * * *